US007331451B2

(12) United States Patent
Focke et al.

(10) Patent No.: US 7,331,451 B2
(45) Date of Patent: Feb. 19, 2008

(54) CIGARETTE PACKAGE WITH COUPON AND METHOD AND DEVICE FOR THE PRODUCTION THEREOF

(75) Inventors: Heinz Focke, deceased, late of Verden (DE); by Jurgen Focke, legal representative, Verden (DE); by Doris Focke, legal representative, Verden (DE); Irmin Steinkamp, Seevetal (DE)

(73) Assignee: Focke & Co., (GmbH & Co. KG), Verden (DE)

( * ) Notice: Subject to any disclaimer, the term of this patent is extended or adjusted under 35 U.S.C. 154(b) by 691 days.

(21) Appl. No.: 10/433,892

(22) PCT Filed: Dec. 4, 2001

(86) PCT No.: PCT/EP01/14185

§ 371 (c)(1),
(2), (4) Date: Mar. 18, 2004

(87) PCT Pub. No.: WO02/48005

PCT Pub. Date: Jun. 20, 2002

(65) Prior Publication Data

US 2006/0091025 A1 May 4, 2006

(30) Foreign Application Priority Data

Dec. 11, 2000 (DE) ..... 100 61 600

(51) Int. Cl.
*B65D 85/10* (2006.01)
*B65B 35/30* (2006.01)

(52) U.S. Cl. ..... 206/264; 206/831; 53/170; 53/445

(58) Field of Classification Search ..... 206/242, 206/831, 264–275, 459.5; 40/312; 53/133.5, 53/170, 412, 445
See application file for complete search history.

(56) References Cited

U.S. PATENT DOCUMENTS

| | | | | | |
|---|---|---|---|---|---|
| 3,695,422 | A | * | 10/1972 | Tripodi | 206/831 |
| 5,035,935 | A | | 7/1991 | Thomas et al. | |
| 5,250,134 | A | * | 10/1993 | Thomas et al. | 206/242 |
| 5,375,704 | A | * | 12/1994 | Focke et al. | 206/268 |
| 5,533,612 | A | * | 7/1996 | Focke | 206/268 |
| 5,931,292 | A | * | 8/1999 | Focke et al. | 206/264 |
| 6,105,340 | A | * | 8/2000 | Draghetti | 53/445 |
| 6,138,437 | A | * | 10/2000 | Focke et al. | 53/170 |
| 6,244,017 | B1 | * | 6/2001 | Focke et al. | 53/147 |
| 6,467,614 | B1 | * | 10/2002 | Tallier et al. | 206/264 |

FOREIGN PATENT DOCUMENTS

| | | |
|---|---|---|
| DE | 197 43 120 A1 | 4/1999 |
| JP | 11-130173 | 5/1995 |
| WO | WO 99/42387 A1 | 8/1999 |
| WO | WO 00/35756 A1 | 6/2000 |

* cited by examiner

*Primary Examiner*—Bryon P Gehman
(74) *Attorney, Agent, or Firm*—Sughrue Mion, PLLC.

(57) ABSTRACT

A cuboidal cigarette pack with a large-surface-area pack side, namely rear side (13), is provided with a blank (23), which serves as a printing carrier, in the region of this rear side (13). The blank is positioned between an outer wrapper (19) of film and the pack (10). A top region of the blank (23) is connected to a detachable top part of the outer wrapper, namely a film cap (22), and is also removed when the pack (10) is opened for the first time.

8 Claims, 6 Drawing Sheets

Figure 4:
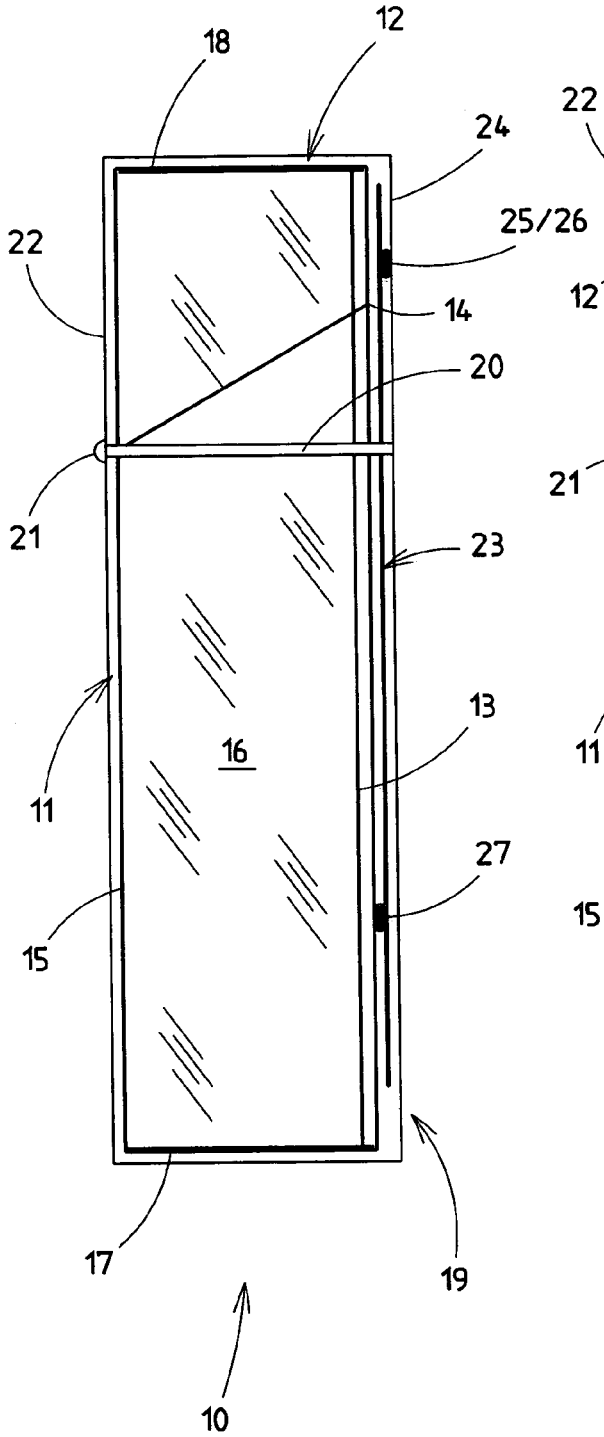

Fig. 1
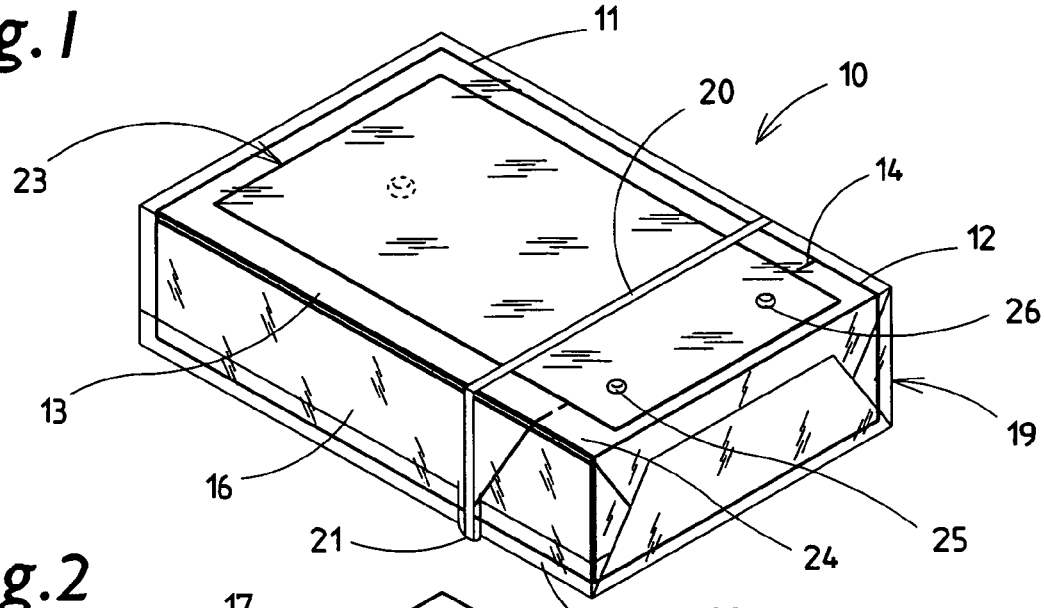
Fig.2
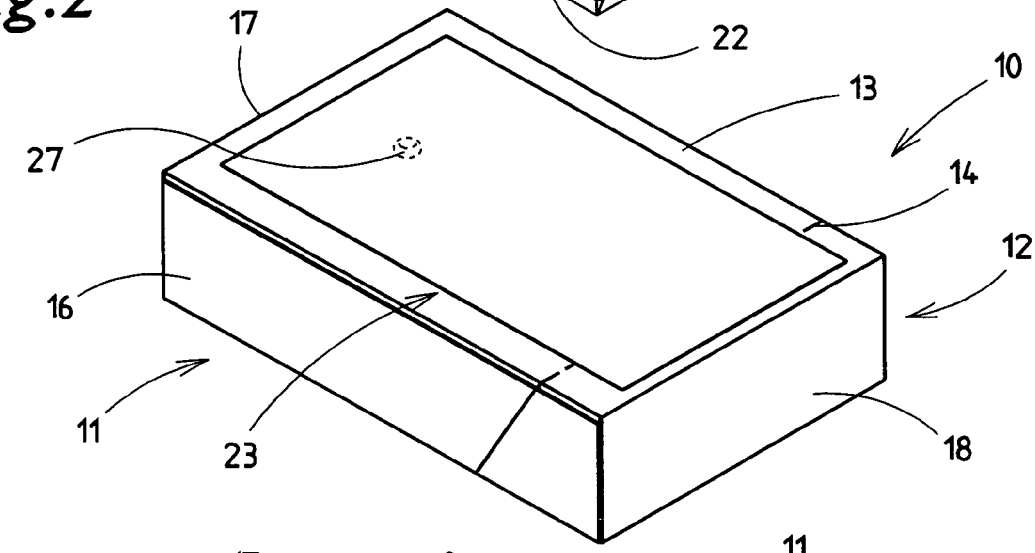
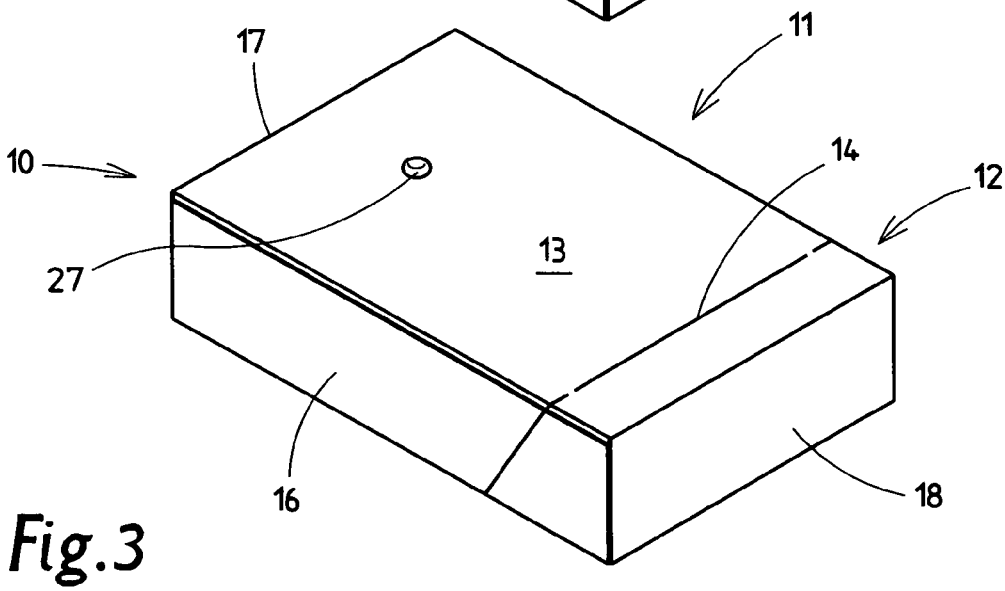
Fig.3

CIGARETTE PACKAGE WITH COUPON AND METHOD AND DEVICE FOR THE PRODUCTION THEREOF

BACKGROUND OF THE INVENTION

1. Description

The invention relates to a pack, in particular cigarette pack, having a large-surface-area front side and a corresponding rear side and also having an outer wrapper made of film which has a tear-open strip running all the way round, a separate blank being positioned, as a printing carrier, in particular a coupon, between the outer wrapper and the (cigarette) pack. The invention also relates to a method of producing such packs and to an apparatus.

2. Summary of the Invention

There are increasing requirements, in the fabrication of cigarette packs, for sheet-like inserts with printed information or advertising material to be fitted on the pack. Various proposals are known for adding printing carriers made of thin paper or the like to the cigarette pack, to be precise even in the region between the conventional outer wrapper made of film and the pack itself.

The object of the invention is to propose a pack in the case of which the insert, namely the separate blank, is fitted straightforwardly in packaging terms and is presented in a user-friendly manner when the pack is opened for the first time, with the result that the advertising or information reaches the consumer.

In order to achieve this object, the pack according to the invention is characterized by the following features:

a) the blank or printing carrier is fitted in the region between one of the large-surface-area pack side, on the one hand, and the outer wrapper, on the other hand,
b) the blank or printing carrier is connected to the outer wrapper by adhesive bonding.

Positioning the printing carrier in particular on the large-surface-area rear side of the (cigarette) pack makes available a corresponding surface area for imparting information even with the pack closed, because the printing carrier can cover the entire side or rear side of the pack. When the pack is opened for the first time, namely when the wrapper is removed, the fact that the printing carrier is connected to the wrapper additionally draws the consumer's attention thereto.

A cigarette pack according to the invention in the case of which the printing carrier is fitted on the rear side of the pack and is connected to a top outer-wrapper part which can be detached by tear-open strips—a film cap—is particularly advantageous. When this pack is customarily opened for the first time, the film cap is detached from the outer wrapper. In this case, the printing carrier, which is connected to said film cap, is drawn out of the position within the pack and presented to the consumer.

The amount of printing surface area available may be increased by a multi-layered, in particular concertina-like design of the printing carrier. Moreover, it is a special feature that the printing carrier is connected to the pack or the rear side thereof, to be precise by releasable adhesive bonding. A possible connecting means is a "stick/no stick" type of adhesive, that is to say an adhesive which automatically loses its effect after a certain period of time.

During production of a pack within the context of the invention, the procedure is such that a film web for producing the outer wrapper is provided with areas of glue in a precisely positioned manner, in the region of a film cap which is to be produced, for the attachment of the printing carrier. Spots of glue are preferably applied to the film web in pairs at appropriate intervals from one another, a glue in the form of both a hot-melt and a long-term adhesive being advantageous.

BRIEF DIESCRIPTION OF THE DRAWINGS

Figure 5:
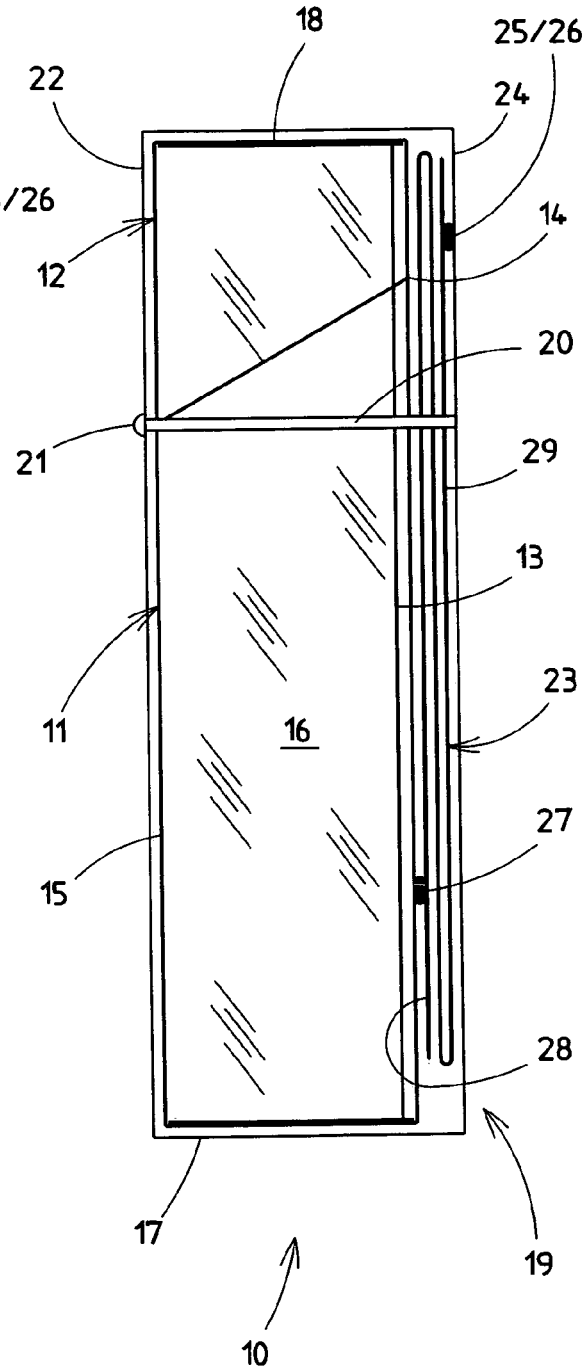
Figure 6:
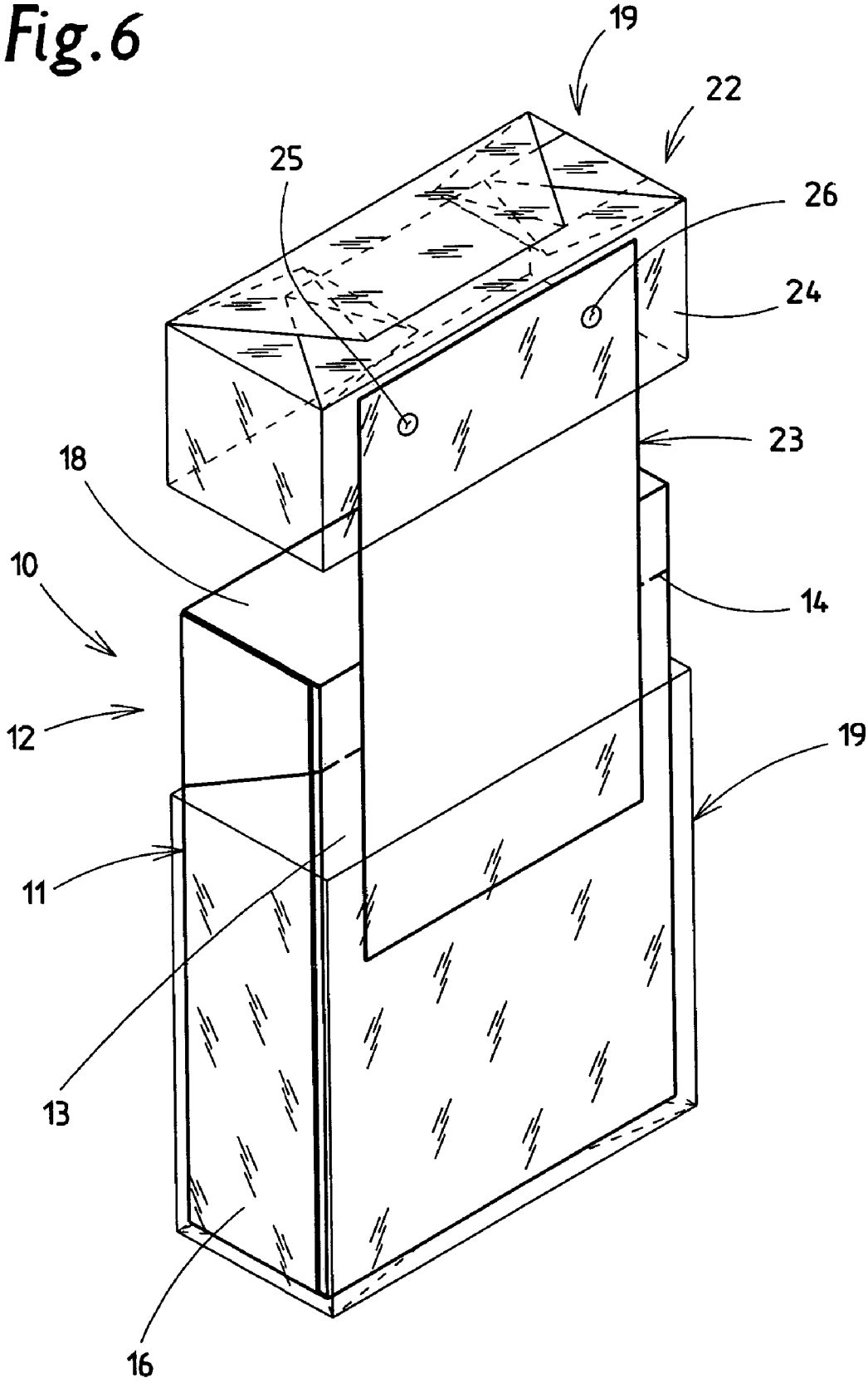
Figure 7:
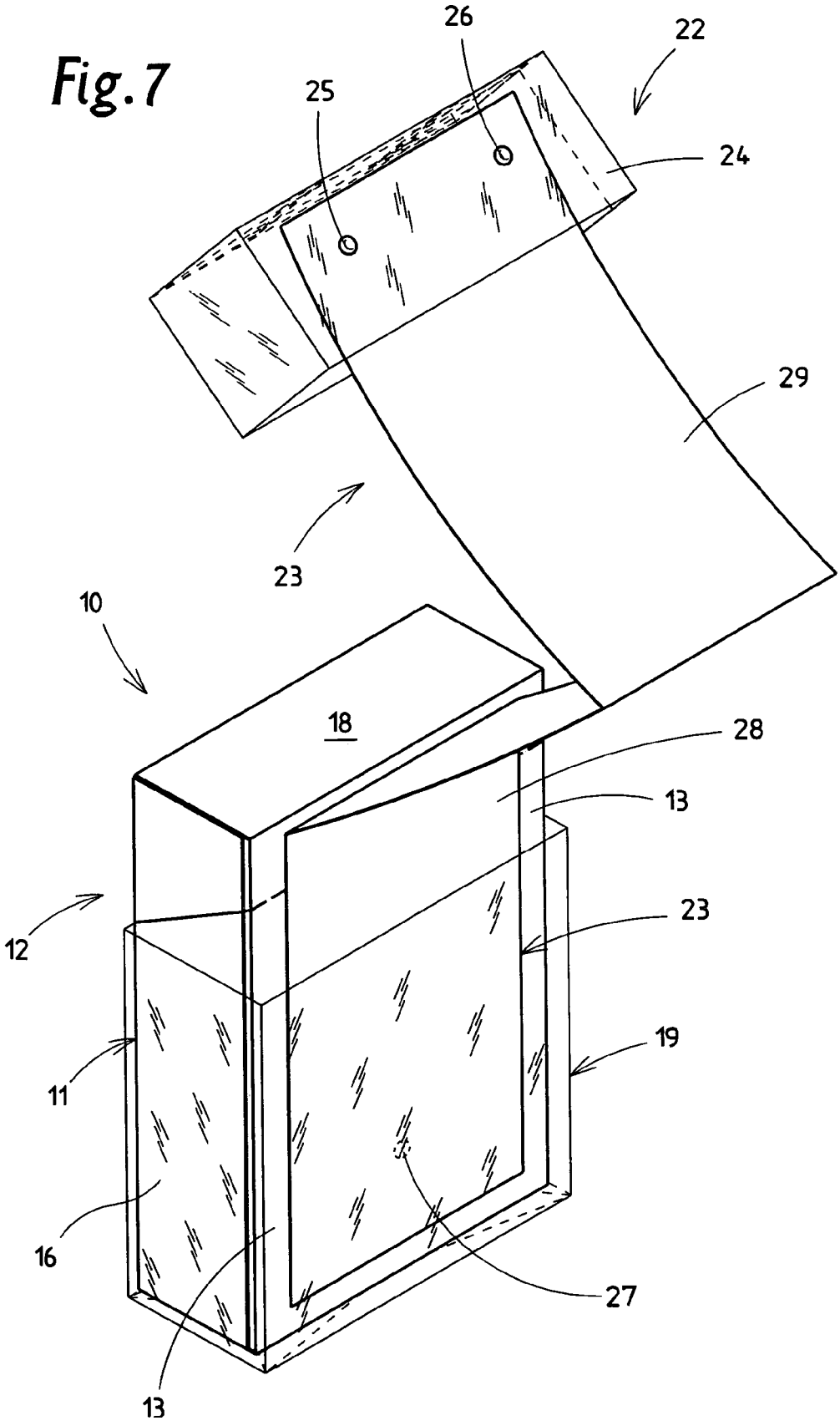
Figure 8:
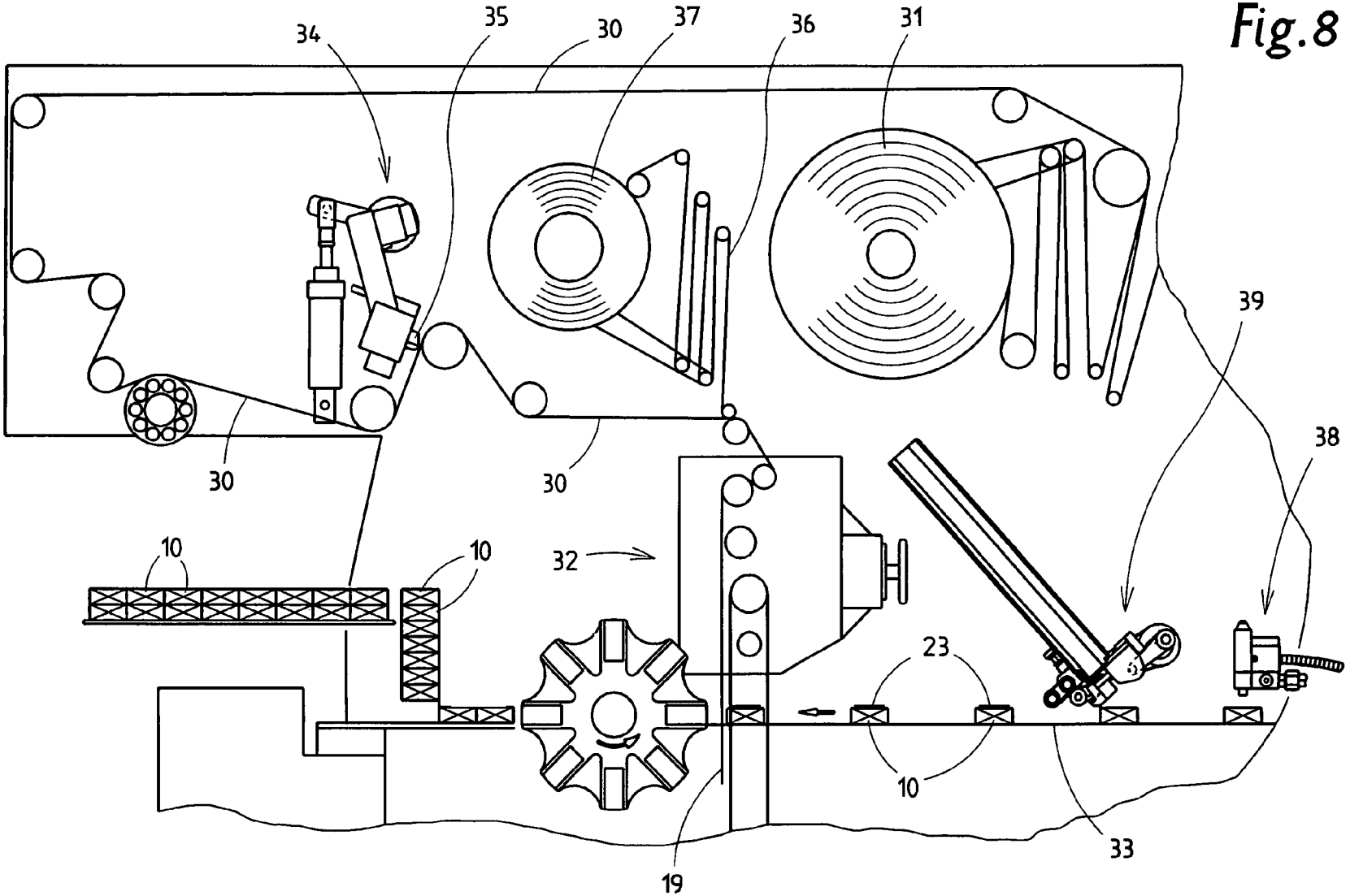
Figure 9:
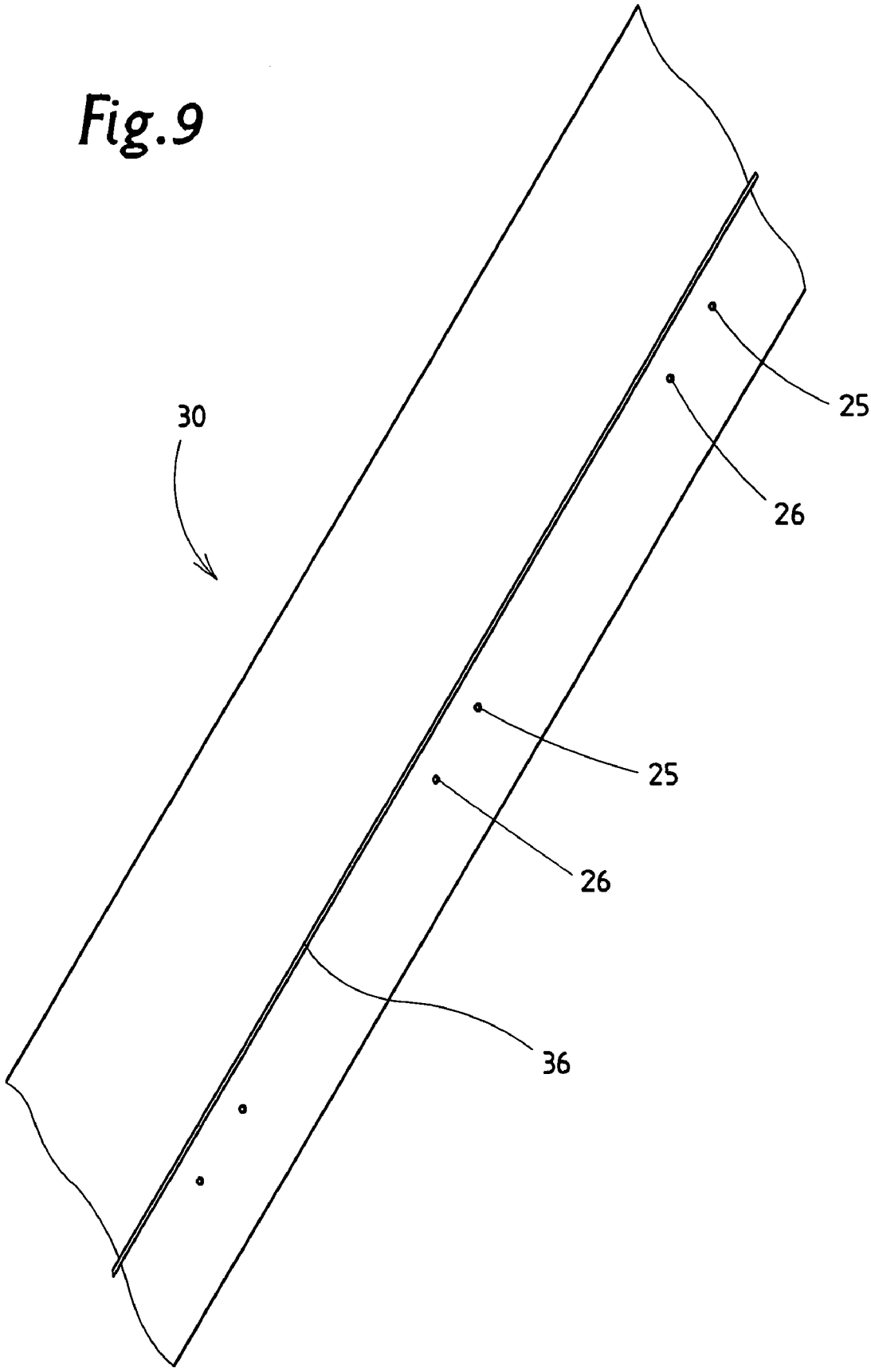

Further details regarding the configuration and production of the packs according to the invention are explained in more detail hereinbelow with reference to the drawings, in which:

FIG. 1 shows a perspective view of a cigarette pack,

FIG. 2 shows, likewise in a perspective illustration, the pack according to FIG. 1 during a production phase, FIG. 3 shows the pack according to FIG. 2 without a printing carrier, FIG. 4 shows a side view of the pack according to FIG. 1, FIG. 5 shows an illustration corresponding to FIG. 4 of a different exemplary embodiment of the pack, FIG. 6 shows a perspective illustration of the pack according to FIG. 1 during the opening process, FIG. 7 shows, likewise in a perspective illustration, the pack according to FIG. 5 during the opening process, FIG. 8 shows a schematic side view of an apparatus for producing packs with printing carriers, and FIG. 9 shows a portion of a film web for an outer wrapper of a pack.

DESCRIPTION OF PREFERRED EMBODIMENTS

The drawings concern the configuration and production of cigarette packs, that is to say of cuboidal pack, which have at least two mutually opposite (large) surfaces. This applies to the packs 10 of the hinge-lid-box type, which are illustrated as the preferred example. This type of pack is constructed from a (bottom) box part 11 and a lid 12. The two parts are connected to one another such that they can be pivoted in the region of a transversely directed linear articulation 14 in the region of a large-surface-area rear side 13 of the pack 10. Accordingly, the rear side 13 of the pack 10 is in one piece throughout.

A correspondingly large-surface-area front side 15 is formed opposite. Furthermore, the pack 10 is bounded by narrow, upright side surfaces 16 and by a base surface 17 and end surface 18.

The resulting pack 10 is fully enclosed by an outer wrapper 19. The latter consists of a thin, transparent or clear film. The outer wrapper 19 is removed, at least in part, when the pack 10 is opened for the first time. For this purpose, connected to the outer wrapper 19, in a top region directed toward the end surface 18, is a tear-open strip 20 running all the way round. A free, outer end of the tear-open strip 20 serves as a grip end 21. For the purpose of opening the outer wrapper 19, the latter is severed with the aid of the tear-open strip 20 such that a top sub-region of the outer wrapper 19 is completely detached from a bottom part. The top part of the outer wrapper, a film cap 22, is removed.

The pack 10 is provided with a separate blank 23. The latter consists of thin material, in particular paper. The blank 23 serves as a printing carrier, that is to say for receiving printed information and/or decoration, for example advertising and factual information, but also details for participation in prize draws.

The blank 23 is positioned in the region between the pack 10 and the outer wrapper 19, to be precise on one of the large pack surfaces. It is particularly favorable for the blank 23 to be arranged in the region of the large-surface-area rear side 13, since the latter is designed in one piece throughout. The blank 23 is dimensioned such that it extends more or less over the entire surface of the rear side 13. The outside of the blank 23 is clearly visible through the outer wrapper 19, with the result that appropriate printing and/or information may be provided in this region.

The blank 23 is dimensioned and positioned such that a sub-region of the same is located in that part which can be removed when the outer wrapper 19 is opened, that is to say in the region of the film cap 22. The blank 23 is connected to the outer wrapper 19 such that the blank 23 is removed with this outer wrapper 19.

A special feature is the connection of the blank 23 to the detachable film cap 22 in the region of a cap rear wall 24. When the outer wrapper 19 is opened, the connection causes the blank 23 to be drawn out of position along with the film cap 22, to be precise without being destroyed or impaired in any other way (FIG. 6).

The blank 23 is connected to the outer wrapper 19 by adhesive bonding. It is favorable for the blank 23 to be fastened on the cap rear wall 24 by a plurality of, in particular two, spots of glue 25, 26. These are spaced apart from one another adjacent to the end boundary of the blank 23, namely virtually at the top corners of the blank 23. The spots of glue 25, 26 may comprise a long-lasting adhesive, to be precise also in hot-melt form.

Provision is also made for the blank 23 to be connected to the pack 10 in a region which is located at the bottom or remote from the spots of glue 25, 26, namely connected to the rear side 13 of the pack in the region of the box part 11. This connection has to be easily releasable in order that the blank 23 can easily be withdrawn from the position on the rear side 13 when the film cap 22 is removed. Provided for this purpose is a single, central blob of glue 27, which connects the blank 23 to the rear side 13. This connection has, in particular, the purpose of ensuring that the blank 23 is positioned precisely on the pack 10 during the production process and thereafter, at any rate before the pack is opened for the first time. The blob of glue 27 may advantageously consist of the "stick/no stick" type of glue, that is to say glue with a decreasing adhesive action.

In order to increase the useful surface area, the blank 23 may be of multi-layered design. According to FIG. 5, the blank 23 is folded in a concertina-like manner as an elongate strip, for example to the width of the rear side 13. An inner leg 28 butts against the rear side 13 and has a free end directed downward. An outer leg 29 is directed toward the outer wrapper 19 and has a free end oriented upward. The inner leg 28 is connected (in a releasable manner) to the pack 10 in the bottom region, via the blob of glue 27, and the outer leg 29 is connected to the outer wrapper 19 or the film cap 22 via preferably two spots of glue 25, 26. In the case of the concertina-like arrangement of the blank 23, folding lines are directed transversely at the top and bottom regions of the rear side 13.

When the pack 10 is opened for the first time by virtue of the film cap 22 being lifted off, the latter causes the folded blank 23 first of all to be unfolded and then to be drawn out of the position on the rear side 13 (FIG. 7). Accordingly, the blank 23 is not just drawn out of the position between the outer wrapper 19 and the pack 10, but is also unfolded in the process.

A further special feature is the production of packs 10 of the type described. In the case of the apparatus shown schematically in FIG. 4, a film web 30 is withdrawn from a reel 31 and fed to a blank subassembly 32. In the region of the latter, blanks for the outer wrapper 19 are severed in the region of a vertical plane and transferred to packs 10, which can be fed along a horizontal pack path 33, likewise to the blank subassembly 32.

In the region of a glue station 34, the film web 30 is provided with glue, preferably with the spots of glue 25, 26, for the purpose of fixing the blank 23. A glue subassembly 35 is provided for this purpose, and preferably applies the spots of glue by glue nozzles.

The tear-open strip 20 is then applied to the film web, to be precise as a strip web 36, which is likewise withdrawn from a reel 37. The blank for the outer wrapper 19, this blank being produced in the blank subassembly 32, thus already has the tear-open strip 20 and spots of glue 25, 26. As can be seen from FIG. 9, the latter are applied in a precisely positioned manner to the film web 30 as pairs of spots of glue 25, 26, corresponding to the position within the blank which is to be produced, to be precise alongside the tear-open strip 20 or the strip web 36.

The packs 10, which are fed from a corresponding packer, are glued, namely provided with the blob of glue 27, on the upwardly oriented rear side 13 of the pack 10, in the region of the pack path 33, by a glue subassembly 38. The glue subassembly 38 has a glue nozzle which discharges an appropriate portion of glue from above.

Following the glue subassembly 38, a subassembly for applying the blanks 23 to the packs 10, that is to say a blank supplier 39, is positioned above the pack path 33. Said blank supplier transfers a blank 23 of the configuration according to FIG. 4 or 5, with precise relative positioning in each case, onto the rear side of the pack 10, the blank 23 being fixed by the blob of glue 27. Thereafter, in the region of the blank station 32, the blank of the outer wrapper 19 is folded in the customary manner around the pack 10, which has been prepared in respect of the blank 23.

The measures described can also be used analogously for cigarette packs of the soft-carton type or capped-box type. With corresponding fabrication, the blank 23 may alternatively be connected to the outer wrapper 19 and/or the pack 10 by thermal sealing.

LIST OF DESIGNATIONS

10 Pack
11 Box part
12 Lid
13 Rear side
14 Linear articulation
15 Front side
16 Side surface
17 Base surface
18 End surface
19 Outer wrapper
20 Tear-open strip
21 Grip end
22 Film cap
23 Blank
24 Cap rear wall
25 Spot of glue
26 Spot of glue
27 Blob of glue
28 Leg
29 Leg
30 Film web
31 Reel
32 Blank subassembly
33 Pack path
34 Glue station

35 Glue subassembly
36 Strip web
37 Reel
38 Glue subassembly
39 Blank supplier

The invention claimed is:

1. A pack having a large-surface-area front side (15) and a corresponding rear side (13) and also having an outer wrapper (19) made of film which has a tear-open strip (20) which runs all the way around the wrapper (19) and is intended for detaching a film cap (22) of the outer wrapper (19), a separate blank (23) being positioned as a printing carrier between the outer wrapper (19) and the pack (10), in the region of a large-surface-area pack side (13, 15), and being connected to the inside of the outer wrapper, characterized by the following features:

a) the blank (23) is connected to the outer wrapper (19), exclusively in the region of the film cap (22), by one of adhesive bonding and thermal sealing, and b) the blank (23) is further connected to the pack in the region of the large-surface-area pack side (13, 15) by an easily releasable blob of glue (27).

2. The pack as claimed in claim 1, characterized by the following features:

a) the blank (23) is arranged in the region of a rear side (13) of the pack, b) the blank (23) is connected to the detachable film cap (22) in the region of a cap rear wall (24), c) the blob of glue (27) for releasably connecting the blank (23) to the pack is arranged in the region of the rear side (13).

3. The pack as claimed in claim 1, characterized in that the blank (23) is connected to the outer wrapper (19) by two spots of glue (25, 26) which are spaced apart from one another on the inside of the outer wrapper (19) in the region of the film cap (22).

4. The pack as claimed in claim 1, characterized in that the blank (23) is of rectangular design with dimensions which are slightly smaller than the dimensions of the rear side (13).

5. The pack as claimed in claim 1, characterized in that the blank (23) is of multi-layered design such that an inner leg (28) of the folded blank (23), said leg being (23) is connected to the rear side 13 and has a free end directed downward, and sue that an outer leg (29), which is connected to at least one of the outer wrapper (19) and the film cap (22), has a free end directed upward.

6. A method of producing the pack as claimed in claim 1, characterized by the following steps:

a) a film web (30) is provided with spots of glue at intervals from one another in the region of the film cap (22), b) a continuous tear-open strip (20) in the form of a strip web (36) is then fitted in a precisely positioned manner on the film web (30), c) in the region of a blank subassembly (32), a blank for the outer wrapper (19) is severed from the film web (30) and held ready in an upright plane, d) on a transversely directed, horizontal pack path (33), the pack with the blank (23) fitted in a precisely positioned manner on the top side is fed to the blank subassembly (32), and e) the outer wrapper (19) is folded around the pack (10) provided with the blank (23), the spots of glue (25, 26) being connected to the blank (23).

7. The method as claimed in claim 6, characterized by the following features:

a) the pack (10) is transported along a pack path (33) with the rear side (13) oriented upward, b) a blob of glue (27) is applied to the rear side (13) of the pack (10), c) thereafter, the blank (23) is applied to the rear side (13) of the pack (10) in the region of the blob of glue (27), and d) the outer wrapper (19) is then folded around the pack (10).

8. An apparatus for producing the pack as claimed in claim 1, comprising:

a) means for conveying a film web (30), for producing blanks for the outer wrapper (19), through a glue station (34) for the purpose of applying spots of glue (25, 26), b) means for fitting a continuous strip web (36) on the film web (30) for the purpose of forming a tear-open strip (20), c) in the region of a blank subassembly (32), means for severing blanks for the outer wrapper (19) from the prepared film web (30) in a vertical plane, d) on a horizontal pack path (33), means for feeding the pack (10) to the blank subassembly (32) for the purpose of receiving a prepared outer wrapper (19), and e) arranged above the pack path (33), as seen in the conveying direction, a glue subassembly (38) for applying the blob of glue (27) to the pack (10) and, following this, a blank supplier (39) for providing the blank (23).

* * * * *